United States Patent [19]

Tsuji et al.

[11] Patent Number: 4,598,494

[45] Date of Patent: Jul. 8, 1986

[54] APPARATUS FOR CLOSING FIREPROOF DOORS

[75] Inventors: Toshihide Tsuji, Sagamihara; Yoshinori Ioka, Yotsukaido; Hisatugu Anzai, Machida; Noboru Kasahara; Fujio Katagiri, both of Fuchu, all of Japan

[73] Assignees: Ryobi Ltd., Fuchu; Hochiki Corporation, Tokyo, both of Japan

[21] Appl. No.: 637,857

[22] Filed: Aug. 6, 1984

[51] Int. Cl.[4] ..... E05F 15/20

[52] U.S. Cl. ..... 49/2; 49/345; 49/346; 49/31; 16/48.5

[58] Field of Search ..... 49/1, 2, 31, 339, 340, 49/345, 346; 16/48.5, 49

[56] References Cited

U.S. PATENT DOCUMENTS

| | | | |
|---|---|---|---|
| 4,040,143 | 8/1977 | Lasier et al. | 49/31 X |
| 4,348,835 | 9/1982 | Jones et al. | 49/345 X |
| 4,506,407 | 3/1985 | Downey | 16/48.5 |

FOREIGN PATENT DOCUMENTS 1555857 11/1979 United Kingdom .

*Primary Examiner*—Kenneth Downey

*Attorney, Agent, or Firm*—Frishauf, Holtz, Goodman & Woodward

[57] ABSTRACT

In an apparatus for closing a fireproof door in case of emergency, the fireproof door and a release, which is secured to a door frame, are interconnected by a link mechanism comprising first, second and supplemental link arms. One end of the first link arms is pivoted to a driving shaft of a door closer secured to the fireproof door. The other end of the first link arm is pivoted to one end of the second link arm, the other end of which is pivoted to the release. The supplemental link arm is connected between the central point of the second link arm and a slider which is slidably mounted inside the release and latched by a latch mechanism when the fireproof door is open.

When the slider is released from the latch mechanism by electrizing a solenoid which operates the latch mechanism, the slider is slid inside the release by the closing force of the door closer transmitted via the link mechanism, thereby closing the fireproof door.

1 Claim, 6 Drawing Figures

APPARATUS FOR CLOSING FIREPROOF DOORS

BACKGROUND OF THE INVENTION

This invention relates to an apparatus for closing a fireproof door in case of emergency.

In the prior closing apparatus, a straight arm is interconnected between a driving shaft of a door closer secured to a fireproof door and a slider slidably mounted inside a release secured to a door frame. The sliding movement of the slider is prevented by a latch mechanism, which is arranged inside the release and operated by a solenoid, for maintaining the firepoof door in its open position against a closing force of door closer. When the fireproof door must be closed in case of emergency such as fire, a solenoid is electrized to operate the latch mechanism to release the slider so as to be slid by the closing force of the door closer to close the fireproofdoor.

With the above prior apparatus, however, opening angle of the fireproof door is limited to less than 130° as an arm interconnecting the door closer and the slider is the single and straight one. Thus, it is not able to be utilized for fireproof doors, the opening angle of which is over 130°.

SUMMARY OF THE INVENTION

Accordingly, an object of the invention is to provide an improved closing apparatus applicable to fireproof doors having opening angles of more than 130°.

Another object of the invention is to provide an improved closing apparatus capable of smoothly and accurately closing fireproof doors.

Further object of the invention is to provide an improved closing apparatus having a simple construction and foldable within the width of a door frame when a fireproof door is closed.

According to the invention, there is provided an apparatus for closing a fireproof door, wherein the fireproof door is hinged to a door frame swingably between its closing and opening positions, which comprises; a door closer secured to the fireproof door and having a driving shaft; a release secured to the door frame and provided with a longitudinal slot on the upper surface thereof; a slider slidably mounted inside said release and provided with a pin extending outwardly through said slot of the release; a latch mechanism arranged inside the release to prevent the sliding movement of said slider; a first link arm, one end of which being pivoted to said driving shaft of the door closer; a second link arm, one end of which being pivoted to the other end of said first link arm, and the other end of which being pivoted to said release; and a supplemental link arm, one end of which being pivoted to said pin of the slider, and the other end of which being pivoted to the intermediate point of said second link arm; wherein the sliding movement of said slider being prevented by said latch mechanism when the fireproof door is fully open so as to maintain the fireproof door in its opening position, while the fireproof door is closed by the closing force of said door closer when the latch mechanism releases the slider.

DESCRIPTION OF THE PREFERRED EMBODIMENTS

Figure 1:
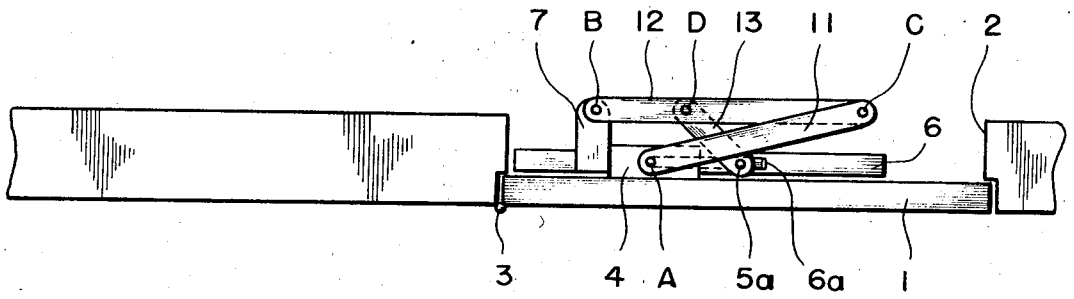
FIG. 1 is a plan view showing a closing apparatus for a fireproof door embodying the invention wherein the fireproof door is closed.

Referring to FIG. 1, a fireproof door 1 is swingably connected to a door frame 2 by hinges 3. A well-known door closer 4 which stores closing force upon opening the fireproof door 1 is secured to the fireproof door 1. A release 6 mounting a slider 5 therein is secured to the door frame 2 in parallel with the fireproof door 1 in its closed position.

A first link arm 11 is pivoted to a driving shaft A of the door closer 4 at its one end. The other end of the arm 11 is pivoted to one end of a second link arm 12 by a pivot pin C. The other end of the arm 12 is pivoted by a pivot pin B to the front end of a fixed arm 7 secured to the release 6. A supplemental link arm 13 is pivotally connected by a pivot pin D to the intermediate point of the arm 12 at its one end, while the other end of the arm 13 is pivoted to the pin 5*a* extending from the slider 5 outwardly through a longitudinal slot 6*a* formed on the upper surface of the release 6.

Figure 2:
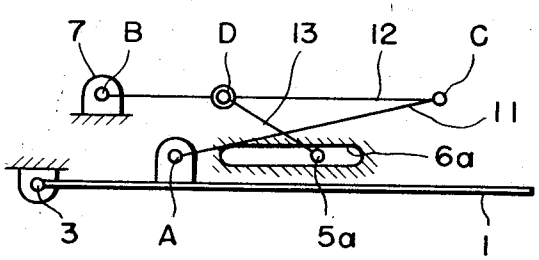
FIG. 2 is a schematic view showing the closing apparatus illustrated in FIG. 1.

As diagrammatically illustrated in FIG. 2, the first link arm 11 and the second link arm 12 constitute double-link mechanism which interconnects the fireproof door 1 and the door frame 2. The supplemental link arm 13, then, regulates the operation of the above double-link mechanism.

Figure 3:
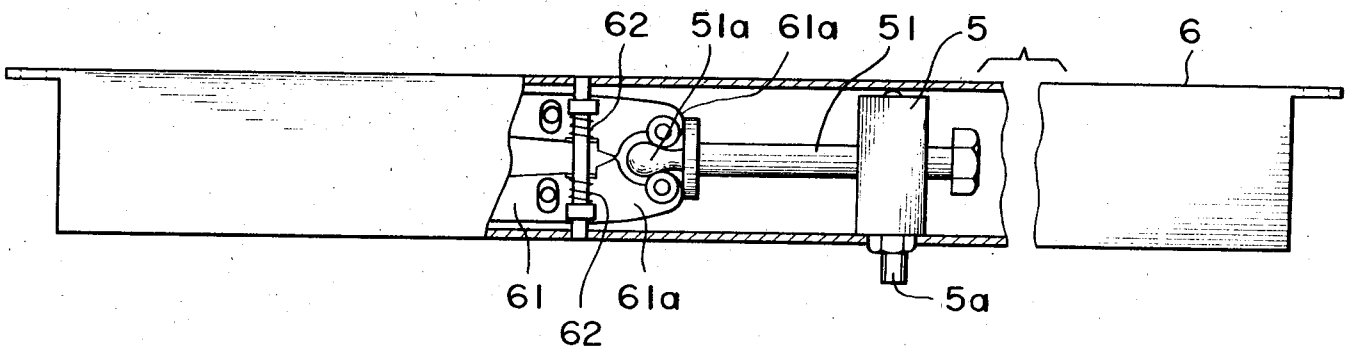
FIG. 3 is a partly-cut front view of a release, wherein a slider is prevented to move by a latch mechanism.
Figure 4:
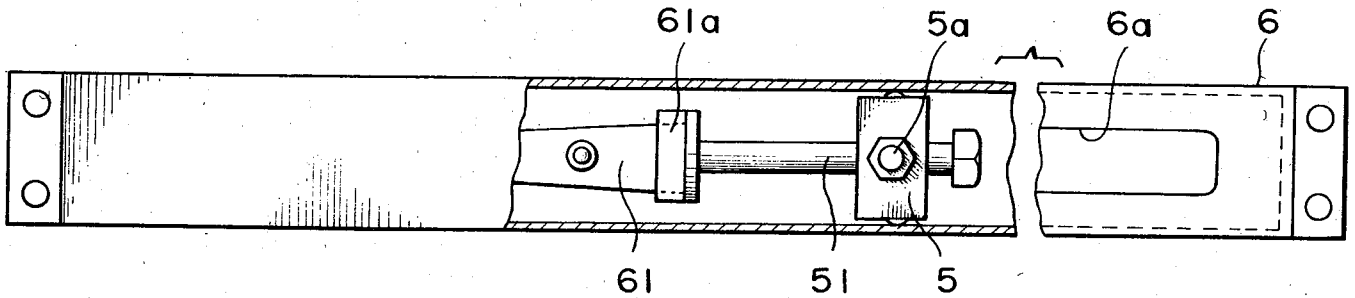
FIG. 4 is a partly-cut plan view of the release illustrated in FIG. 3.

The slider 5 slides inside the release 6, and the enlarged end 51*a* of a slider shaft 51, which is secured to the slider 5, is latched by a latch mechanism 61 arranged inside the release 6, as illustrated in FIGS. 3 and 4, when the fireproof door 1 is open. The latch mechanism 61 is biased to close the opposed ends 61*a*·61*a* by springs 62·62, and is open against biasing force of the springs 62·62 by electrizing a solenoid, not shown, mounted inside the release 6.

The closing apparatus, as above described, operataes as follows.

In the situtation illustrated in FIG. 1, wherein the fireproof door 1 is closed, the link arms 11·12·13 are retracted almost within the width of the door frame 1. At this stage, the slider shaft 51 is released from the latch ends 61*a*·61*a* and the slider 5 is freely slidable inside the release 6.

Figure 5:
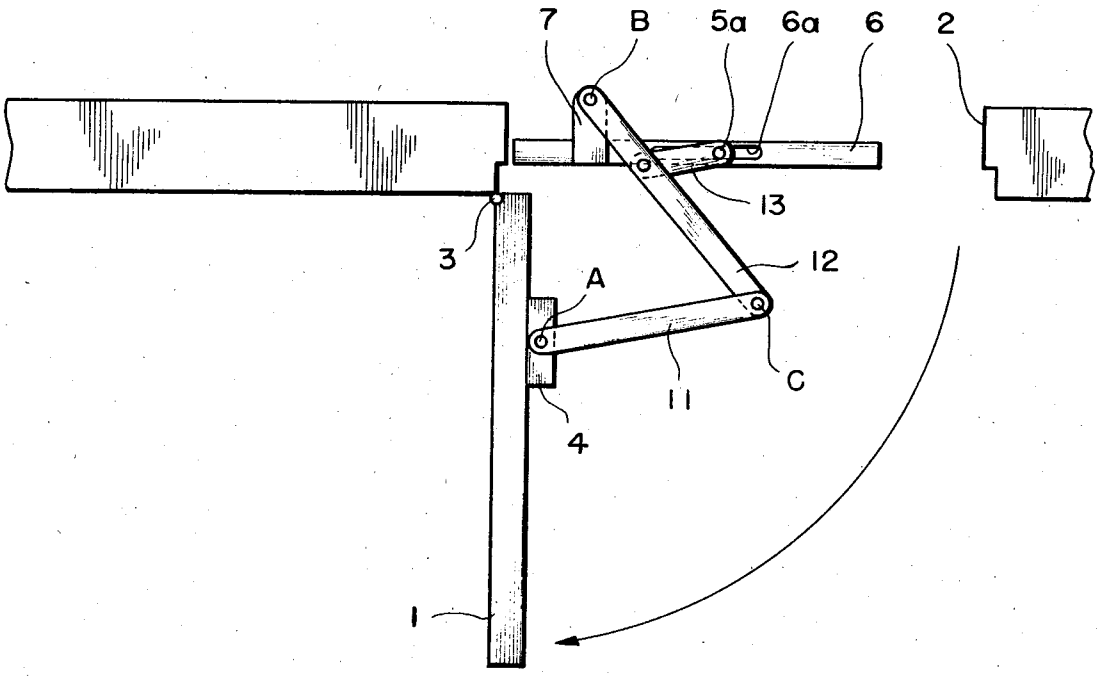
FIG. 5 is a plan view of the closing apparatus shown in FIG. 1, wherein a fireproof door is open at the angle of 90°.

When the fireproof door 1 is open at 90° from the position shown in FIG. 1, the second link arm 12, which is connected to the fireproof door 1 via the first link arm 11, rotates in the clockwise direction about the pivot pin B as illustrated in FIG. 5. Upon this rotation of the arm 12, the slider 5, which is connected to the arm 12 via the supplemental link arm 13, is moved leftwardly inside the release 6.

Figure 6:
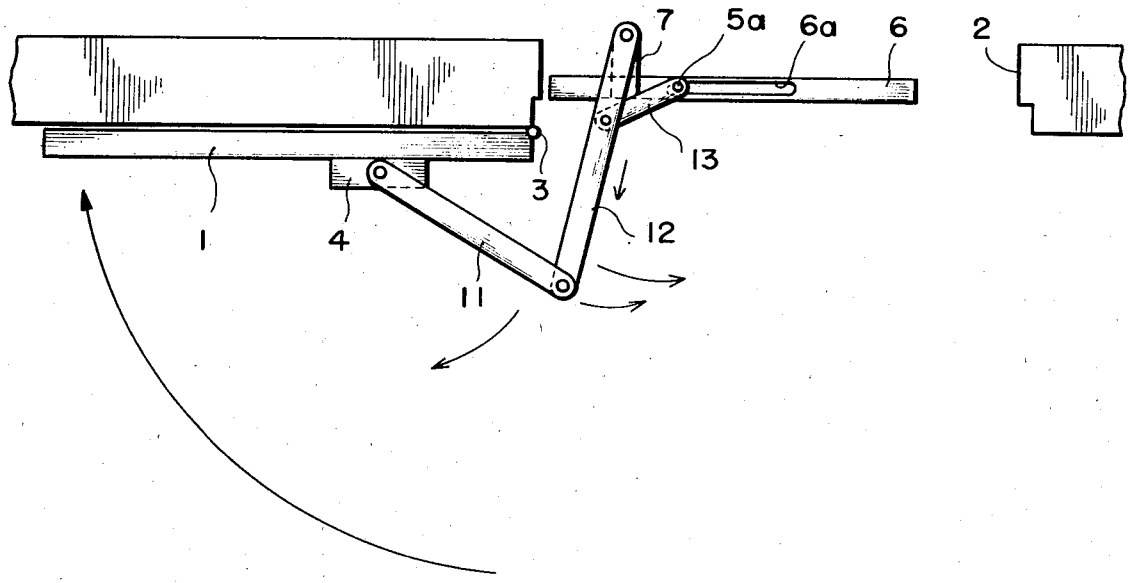
FIG. 6 is a plan view of the closing apparatus shown in FIG. 1, wherein a fireproof door is fully open at the angle of 180°..

When the fireproof door 1 is open at the full angle, i.e., 180° from the position shown in FIG. 1, the second link arm 12 rotates to the position shown in FIG. 6, and the slider 5 is moved to its leftest position where the enlarged end 51*a* of the slider shaft 51 is latched by the pair of latch ends 61*a*·61*a* as illustrated in FIGS. 3 and 4. At this stage, the closing force is restored in the door closer 11 and thereby the second link arm 12 is biased to rotate in the counter clockwise direction. The rotation of the arm 12 is, however, prevented by the supplemental arm 13 which is connected to the slider 5, as the rightward movement of the slider 5 is prevented by the latch mechanism 61. Thus, the fireproof door 1 is maintained at its opening position.

As the fireproof door 1 and the slider 5 in the release 6 is stably connected by link arms 11·12·13, the fireproof door 1 is maintained in its opening position without shaking.

In case of emergency, the solenoid, not shown, is electrized to release the slider sahft 51 from the latch mechanism 61 so that the slider 5 becomes freely movable inside the release 6. At this stage, the closing force of the door closer 4 is applied to the slider 5 via link arms 11·12·13 so as to move it rightwardly in FIG. 6. With the rightward movement of the slider 5, the supplemental link arm 13 and the second link arm 12 rotate in the counter-clockwise direction, thereby closing the fireproof door 1.

As the biasing direction of the closing force of the door closer 4 is alternated by link arms 11·12·13 to be consistent with the sliding direction of the slider 5, the slider 5 smoothly and accurately moves along the slot 6*a* of the release 6.

What is claimed is:

1. Apparatus for closing a fireproof door, wherein the fireproof door is hinged to a door frame swingably between its closing and opening positions, which comprises;

a door closer secured to the fireproof door and having a driving shaft;

a release secured to the door frame and provided with a longitudinal slot on the upper surface thereof;

a slider slidably mounted inside the said release and provided with a pin extending outwardly through said slot of the release;

a latch mechanism arranged inside the release to prevent the sliding movement of said slider;

a first link arm, one end of which being pivoted to said driving shaft of said door closer;

a second link arm, one end of which being pivoted to the other end of said first link arm, and the other end of which being pivoted to said release; and a supplemental link arm, one end of which being pivoted to said pin of the slider, and the other end of which being pivoted to the intermediate point of said second link arm;

wherein the sliding movement of said slider being prevented by said latch mechanism when the fireproof door is fully open so as to maintain the fireproof door in its opening position, while the fireproof door is closed by the closing force of said door closer when the latch mechanism release the slider.

* * * * *